US007893329B2

(12) United States Patent
Proskurnjak

(10) Patent No.: US 7,893,329 B2
(45) Date of Patent: Feb. 22, 2011

(54) CHIN-REST FOR A VIOLIN

(75) Inventor: Vladimir Šimunov Proskurnjak, Varazdin (HR)

(73) Assignee: VŠP d.o.o., Varazdin (HR)

( * ) Notice: Subject to any disclaimer, the term of this patent is extended or adjusted under 35 U.S.C. 154(b) by 0 days.

(21) Appl. No.: 12/447,815

(22) PCT Filed: Oct. 30, 2007

(86) PCT No.: PCT/HR2007/000034

§ 371 (c)(1),
(2), (4) Date: Sep. 14, 2009

(87) PCT Pub. No.: WO2008/053255

PCT Pub. Date: May 8, 2008

(65) Prior Publication Data

US 2010/0064876 A1 Mar. 18, 2010

(30) Foreign Application Priority Data

Oct. 31, 2006 (HR) ..... P 20060375 A

(51) Int. Cl.
*G10D 1/02* (2006.01)

(52) U.S. Cl. ..... 84/278

(58) Field of Classification Search ..... 84/278–281
See application file for complete search history.

(56) References Cited

U.S. PATENT DOCUMENTS 2,486,646 A 11/1949 Halko
6,667,430 B1 * 12/2003 Liao ..... 84/279

FOREIGN PATENT DOCUMENTS

DE 8674 C 1/1880
DE 3216759 C1 12/1983
DE 102005037838 B3 8/2006
WO WO 01/71705 A1 9/2001

OTHER PUBLICATIONS

International Search Report dated Jul. 28, 2008, application No. PCT/HR2007/000034.

* cited by examiner

*Primary Examiner*—Kimberly R Lockett
(74) *Attorney, Agent, or Firm*—RatnerPrestia

(57) ABSTRACT

A chin-rest of a violin is attached to an edge of the resonating box of a violin. An opening is provided in the chin-rest through which an elastic knot for stretching the strings can pass through. This is attached at one place to the string holder and is drawn in a stretched state through the opening of the chin-rest. The opposite end is attached to a fixed end pin so that it comprises a portion of the chin-rest attachment. The chin-rest does not rest on the upper panel of the resonating box of the violin, instead, it is above it by a specified distance "d" and above the string holder.

10 Claims, 6 Drawing Sheets

CROSS-SECTION A-A a Plan view b Side view

CHIN-REST FOR A VIOLIN

CROSS-REFERENCE TO RELATED APPLICATIONS

This application is a U.S. National Phase Application of PCT International Application No. PCT/HR2007/000034, filed Oct. 30, 2007, which claims priority to Croatia Patent Application No. P20060375A, filed Oct. 31, 2006, the content of such applications being incorporated by reference herein in their entirety.

FIELD OF THE INVENTION

The subject invention relates to a chin-rest for stringed instruments, violins and violas.

BACKGROUND OF THE INVENTION

A chin-rest is a part of stringed subtle instruments~violins and violas—and serves to make the instrument easier for the violinist to hold while playing. Over the last 600 years, or since the creation of the first violin, there have been attempts to make the chin-rest an integral part of the violin, while ensuring that its performance and its attachment to the instrument is such that it preserves the autonomy of the resonance of the box and all of its characteristics and traits, and in a way that does not degrade the tonal quality of the violin.

In addition to preserving the autonomy of the resonance of the box of the instrument, other critical demands for the chin-rest are that it is practical in use and that its production costs are low.

The main components of the violin are shown in FIG. 1. These include the chin-rest 1, the resonating box 3, and the string holder 7 (otherwise referred to as a tailgut holder). The manner in which existing chin-rests are positioned on the instrument and in contact with the body of the violin have not essentially changed.

There have been a number of approaches to resolving the above-mentioned technical problem of devising a satisfactory method for attaching the chin-rest to the violin.

It can be concluded from a review of the current state of the technique that none of the existing methods for attaching the chin-rest to the violin achieves to the fullest extent possible an autonomy of the resonating box of the instrument as a crucial goal, and that the criteria of rationality of execution and practical use have not been fulfilled.

In the patent literature many attempts have been described for arriving at a solution to this technical problem.

One such solution is represented by U.S. Pat. No. 6,667, 430. Under this patent the chin-rest is attached to the resonating box of the instrument with a fitted metal structure, which also permits height and angle adjustment of the chin-rest. Besides being complicated in its execution and expensive, this solution is impractical in application. However, its basic shortcoming is that the metal structure rests directly on the upper and the lower walls of the resonating box of the instrument. This changes the instrument's acoustical characteristics and the changes are not eliminated by small pads placed between the metal structure and the wall of the resonating box of the instrument.

The shortcomings of a previous patent have also not been removed by the solution represented by U.S. Pat. No. 4,534, 259, although elastic materials have been used. A undoubted advance in this sense is to be found in invention Number DE 197 17 338. It avoids the traditional method of attachment by use of a screw that is situated at the very end of the violin and which supports the whole construction of the chin-rest. But, at the first glance it can be noticed that this solution is extremely complex, both in its execution and in the manner of attachment to the instrument itself. The attachment of the chin-rest to the instrument also affects the sound quality of the instrument, and the linkage of the all of the parts is extremely complicated.

SUMMARY OF THE INVENTION

The essence of this technical solution for the attachment of the chin-rest is that it is achieved without the use of the usual metal fixatives, without coming into contact with the walls of the resonating box, and without affecting the tonal characteristics of the instrument.

The execution of this technical solution uses the fact that the customary practice for stretching of the string holder (FIGS. 1 and 2, Item 7) is achieved with an elastic knot (FIG. 2, Item 8), which is otherwise referred to as a tailgut, with tension between the string holder and the fixed end pin (FIG. 2, Item 10) running in the direction of the strings on the lower side of the violin and fixed in the existing wooden reinforcement (FIG. 2, Item 9) within the resonating box, which has been presented under Patent Number JP 2000259149.

The execution of the technical solution for the chin-rest in this invention also uses the fact that the connection of the side walls of the violin (FIG. 1, Item 4) with the upper one and the upper panel of the resonating box of the violin creates a firm edge that has a circular shape or similar cross-section (FIG. 2, Item 11, Cross-section A-A). The anatomically produced chin-rest (FIG. 3, a. plan view and b. side view), is designed so that the portion (FIG. 3, Item 12) of the chin rest is attached to the resonating box of the violin, and which continues to the anatomical panel of the chin-rest (FIG. 3., Item 13), forms a channel from the interior side (FIG. 3, Item 14) whose depth and shape are such that the firm edge can be placed on it (FIG. 2, Item 11, Cross-section A-A). In this type of anatomical chin-rest (FIG. 3, a. plan and b. side view), above the channel (FIG. 3, Item 14) at the distance "d" (FIG. 3. Item "d") is situated an opening (FIG. 3, Item 15) of such shape and size that the elastic knot can pass through it (FIG. 2, Item 8).

The string stretcher, in the form of an elastic knot, is attached to the string holder in a single place (FIG. 1, Item 7) and in a stretched state is drawn through an opening in the chin-rest (FIG. 3, Item 15). The opposite end of the elastic knot is attached to the fixed end pin (FIG. 5, Item 10) so that it comprises a part of the chin-rest attachment (FIG. 5, Item 14), pressing it toward the side walls of the violin next to which is a wooden reinforcement in one segment from the interior side of the violin (FIG. 5, Item 9). In this way the chin-rest does not rest on the upper panel of the resonating box of the violin, Instead, it is above it by the specified distance "d" and above the string holder.

BRIEF DESCRIPTION OF THE DRAWING FIGURES

DETAILED DESCRIPTION OF THE INVENTION

This invention describes a method for the specific design of a violin with a solution for a chin-rest whose production can be realized by the use of the usual machinery and appropriate materials, primarily wood.

Figure 2:
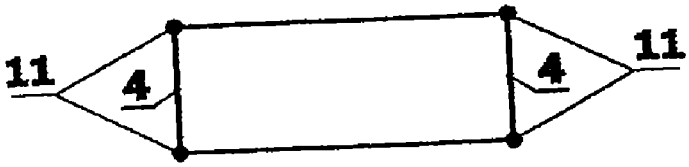
FIG. 2 depicts a partial front elevation view of the conventional violin of FIG. 1 with the chin rest omitted. A cross-sectional view of the violin on FIG. 2 taken along the lines A-A is illustrated above the partial front elevation view.
Figure 2:
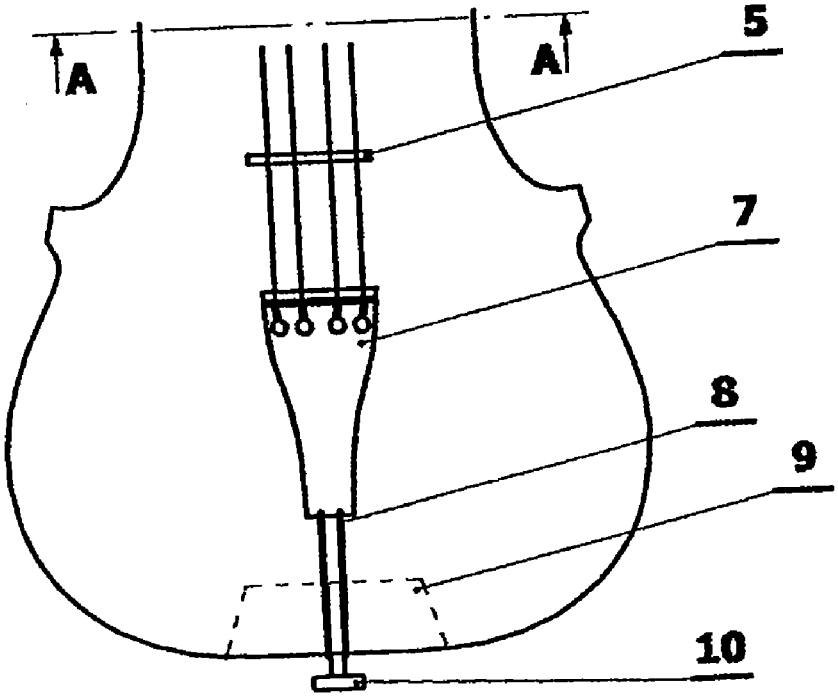

The chin-rest in this invention is designed so that a portion of it that is attached to the resonating box of the violin (FIG. 3, Item 12), and which continues to the panel of the chin-rest (FIG. 3., Item 13), forms a channel from the interior side (FIG. 3, Item 14) whose depth and shape are such that the firm edge can be placed on it (FIG. 2, Item 11, Cross-section A-A).

Figure 3:
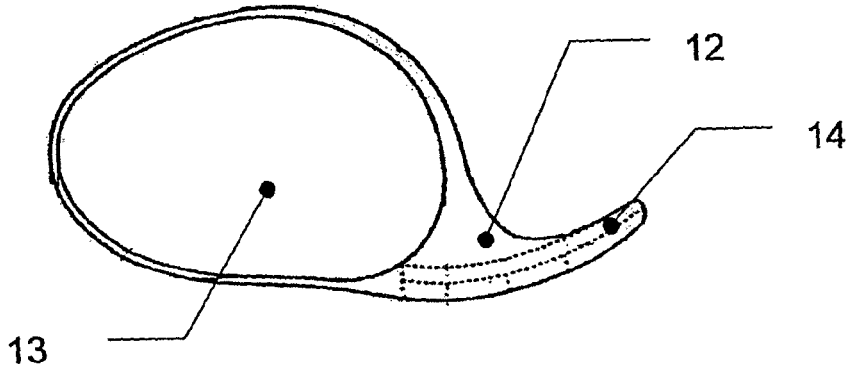
FIG. 3A depicts a plan view of a chin rest according to one exemplary embodiment of the invention.
FIG. 3B depicts a side elevation view of the chin rest of FIG. 3A.
Figure 3:
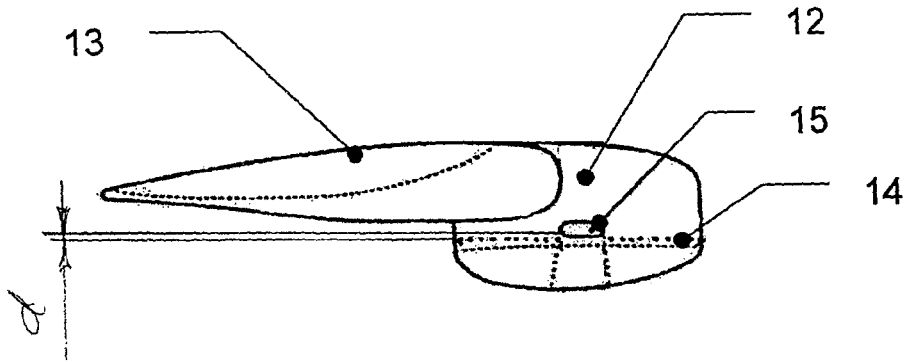
Figure 5:
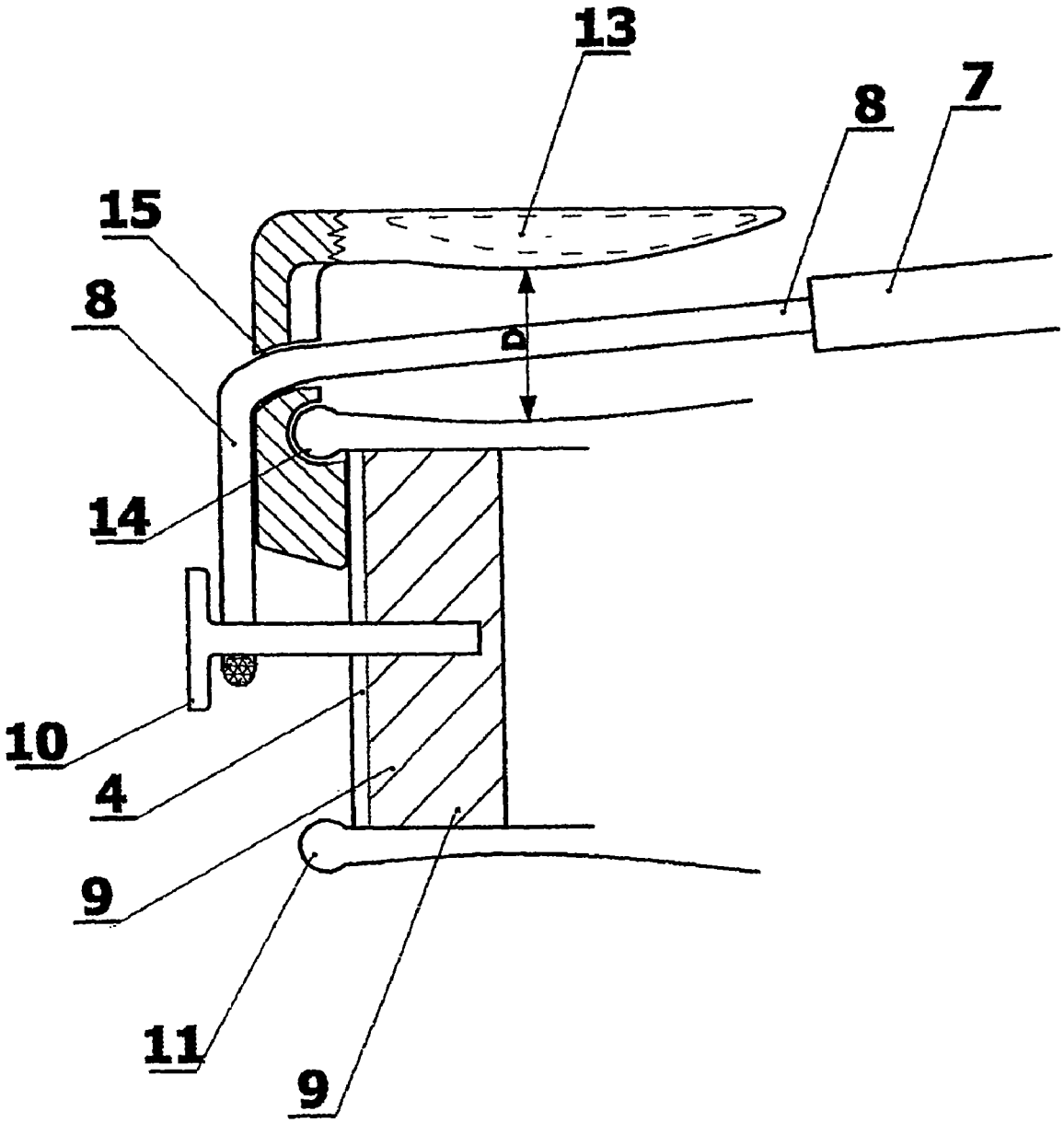
FIG. 5 depicts a cross-sectional view of the violin of FIG. 4 taken along the lines C-C.

In that portion of the chin-rest (FIG. 3, a. plan view and b. side view), above the channel (FIG. 3, Item 14) at the distance "d" (FIG. 3, Item "d") an opening is made (FIG. 3, Item 15) of such shape and size that an elastic knot can pass through it (FIG. 2. Item 8) for stretching the string. This is attached at one place to the string holder and is drawn in a stretched state through the opening of the chin-rest (FIG. 3, Item 15). On the opposite end it is attached to the fixed end pin (FIG. 5, Item 10) so that it comprises a portion of the chin-rest attachment (FIG. 5, Item 14), pressing it toward the side walls of the violin (FIG. 5, Item 4) next to which is a wooden reinforcement in one segment from the interior side of the violin (FIG. 5, Item 9). In this way the chin-rest does not rest on the upper panel of the resonating box of the violin, Instead, it is above it by the specified distance "d" and above the string holder.

Figure 6:
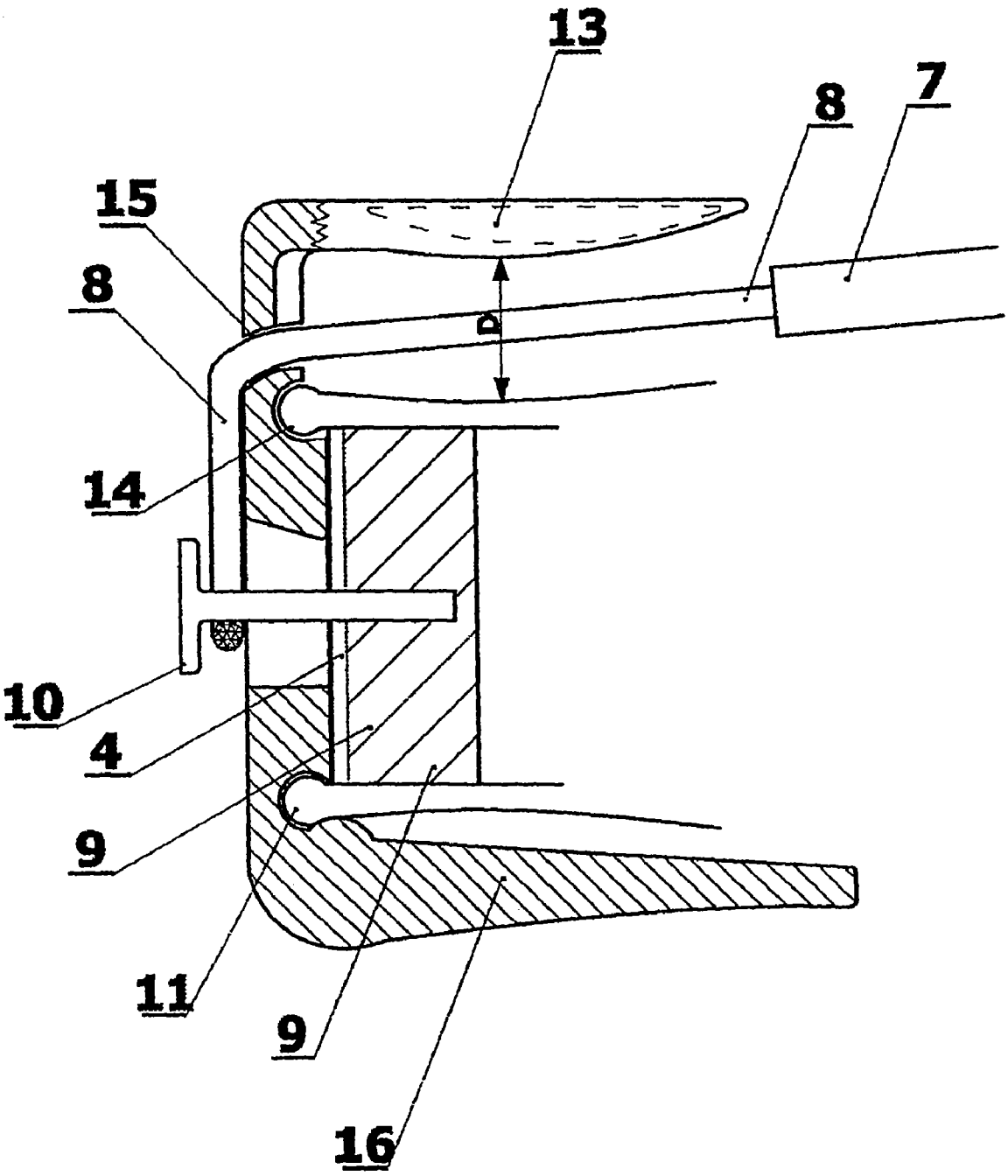
FIG. 6 depicts a cross-sectional view of another exemplary embodiment of a chin rest mounted to the violin of FIG. 2.

The chin-rest attachment to the resonating box of the violin is designed so that it forms an undertray of the violin that rests on the shoulder of the violinist (FIG. 6, Item 16).

The application of the invention is in its production and use with musical instruments, primarily with violins and violas, and their component parts and accessories.

ITEM NUMBER LISTING BY FIGURE

Figure 1:
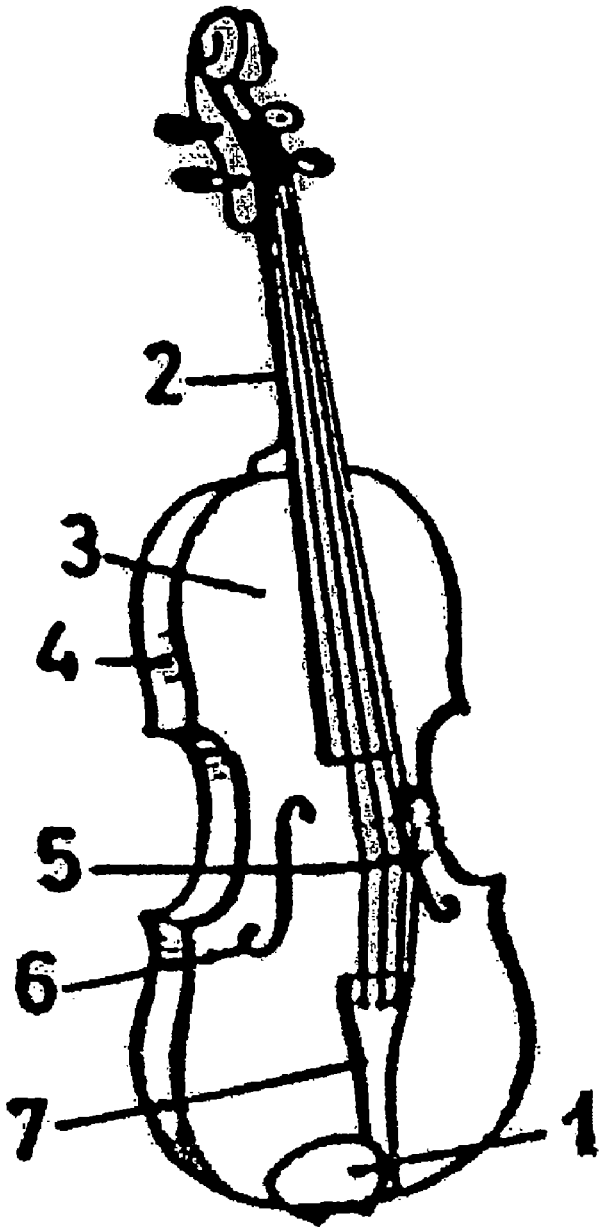
FIGURE 1 PRIOR ART
FIG. 1 depicts a perspective view of a violin having a chin-rest.
Figure 4:
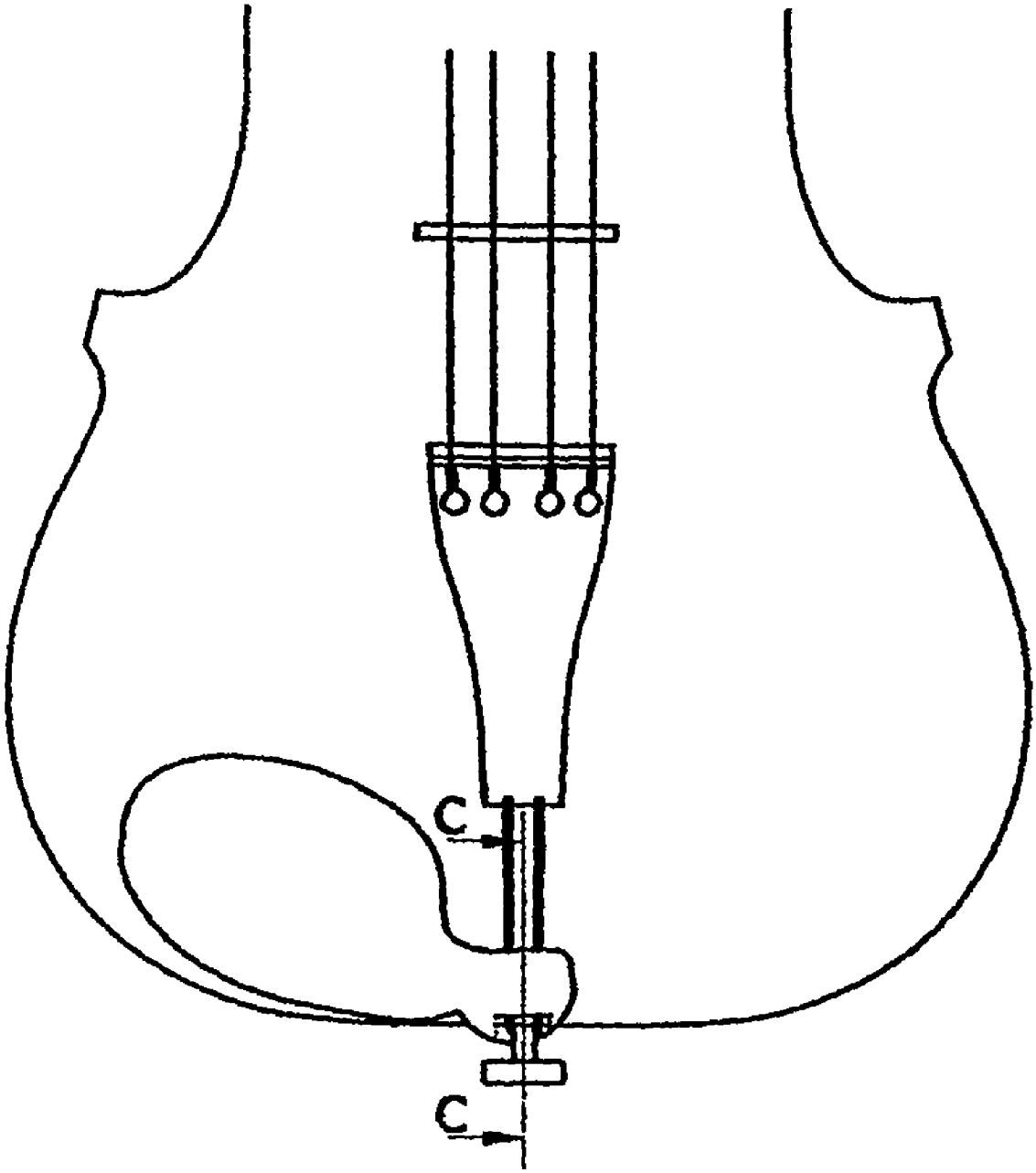
FIG. 4 depicts the chin rest of FIG. 3A mounted to the violin of FIG. 2.

FIG. 1 Item Numbers
1. Chin-rest
2. Neck of the violin
3. Resonating box
4. Side walls
5. Bout
6. F-holes
7. String holder or Tailgut Holder FIG. 2 Item Numbers
8. Elastic string stretcher or Tailgut
9. Wooden reinforcement in one segment of the interior of violin
10. Fixed end pin
11. The edge between the side wall and the upper and lower panels of the violin FIG. 3 Item Numbers
12. The part of the chin-rest that is attached to the edge of the violin
13. Anatomical panel of the chin-rest
14. Channel on part of the chin-rest
15. Penetration through the chin-rest "d" distance of the chin-rest from the upper panel of the violin FIG. 4 Item Numbers
1. Chin-rest
5. Bout
7. String holder
8. Elastic string stetcher
10. Fixed end pin FIG. 5 Item Numbers
4. Side walls
7. String holder
8. Elastic string stretcher
9. Wooden reinforcement on one segment of interior of the violin
10. Fixed end pin
11. The edge between the side wall and the upper and lower panels of the violin
13. Anatomical panel of the chin-rest
14. Channel for part of the chin-rest
14. *a*. Part of the chin-rest for attachment
15. Penetration through the chin-rest "d" distance of the chin-rest from the upper panel of the violin FIG. 6 Item Numbers
4. Side walls
7. String holder
8. Elastic string stretcher
9. Wooden reinforcement in one segment of the interior of violin
10. Fixed end pin
11. The edge between the side wall and the upper and lower panels of the violin
13. Anatomical panel of the chin-rest
14. Channel in part of the chin-rest
14. *a*. Part of the chin-rest for attachment
15. Penetration through the chin-rest "d" distance of the chin rest from the upper panel of the violin
16. Undertray of the violin on the shoulder

The invention claimed is:

1. A chin rest that is configured for mounting to a musical instrument comprising:

a chin support portion including a bottom surface that is positioned to face a top, string-side surface of a musical instrument, and an opposing top surface, wherein at least a portion of the top surface of the chin support portion is adapted to accommodate a chin of a user of the musical instrument; and a mounting portion that extends substantially perpendicular from the chin support portion, the mounting portion defining: (i) an aperture that is positioned to receive a tailgut of a tailpiece, and (ii) a channel that is spaced from the aperture for receiving a protruding edge of the musical instrument, wherein the channel is spaced from the bottom surface of the chin support portion by a pre-determined distance, such that, in use, the chin support portion is spaced from and elevated above the top surface of the musical instrument.

2. The chin rest of claim 1, wherein the mounting portion further comprises another aperture for accommodating an end pin of the musical instrument.

3. The chin rest of claim 1, wherein the mounting portion further comprises another channel for accommodating a second protruding edge of the musical instrument that is spaced from said protruding edge.

4. The chin rest of claim 1, wherein the chin support portion is configured such that it does not contact and is separated from the top, string-side surface of the musical instrument by a pre-determined distance.

5. The chin rest of claim 1, wherein, in use, the chin rest is urged against the musical instrument by the tailgut.

6. The chin rest of claim 1, wherein the chin support portion is integrally formed with the mounting portion.

7. The chin rest of claim 1, wherein the protruding edge protrudes from the top string-side surface.

8. A method of mounting a chin rest to a musical instrument comprising the steps of:

positioning a tailgut of a tailpiece through an aperture defined in the chin rest;

orienting the chin support portion of the chin rest at an elevation above a top, string-side surface of the musical instrument;

positioning a protruding edge of the musical instrument within a channel formed on an interior surface of the chin rest, such that the chin support portion of the chin rest is maintained at an elevation above the top, string-side surface of the musical instrument; and mounting the tailgut of the musical instrument to an end pin of the musical instrument, thereby urging the chin rest against a side wall of the musical instrument that is spaced from the top, string-side surface of the musical instrument.

9. The method of claim 8, wherein the second positioning step further comprising the sub-step of positioning another protruding edge of the musical instrument within another channel formed on the interior surface of the chin rest.

10. A musical instrument comprising:

a resonating box having a top string-side surface and an edge protruding from the top string-side surface;

a tailpiece including a tailgut; and a chin rest comprising a chin support portion including a bottom surface that is positioned to face the top, string-side surface of a musical instrument, and an opposing top surface, wherein at least a portion of the top surface of the chin support portion is adapted to accommodate a chin of a user of the musical instrument, and the chin rest further comprising a mounting portion that extends substantially perpendicular from the chin support portion, the mounting portion defining: (i) an aperture that is positioned to receive the tailgut of a tailpiece, and (ii) a channel that is spaced from the aperture for receiving the protruding edge of the musical instrument, wherein the channel is spaced from the bottom surface of the chin support portion by a pre-determined distance, such that, in use, the chin support portion is spaced from and elevated above the top, string-side surface of the musical instrument.

* * * * *